United States Patent [19]

Henderson

[11] 4,153,000

[45] May 8, 1979

[54] FLOATING AIR ERECTING PAINTING PUNT

[76] Inventor: Chuck A. Henderson, 12300 39th Ave., Kenosha, Wis. 53140

[21] Appl. No.: 830,594

[22] Filed: Sep. 6, 1977

[51] Int. Cl.[2] ..... B63C 5/00

[52] U.S. Cl. ..... 114/222; 114/61; 182/141

[58] Field of Search ..... 114/61, 71, 74 R, 85, 114/222, 249, 250; 182/141; 187/2, 6, 9 R, 17

[56] References Cited

U.S. PATENT DOCUMENTS

| | | | |
|---|---|---|---|
| 2,720,181 | 10/1955 | Brandon | 114/74 R |
| 3,682,265 | 8/1972 | Hiraoki et al. | 114/222 X |
| 3,807,338 | 4/1974 | Shader | 114/61X |
| 3,857,352 | 12/1974 | Schott | 114/61 |
| 3,858,688 | 1/1975 | Galloway | 182/141 X |

FOREIGN PATENT DOCUMENTS

| | | | |
|---|---|---|---|
| 1951107 | 4/1971 | Fed. Rep. of Germany | 114/222 |
| 1294011 | 10/1972 | United Kingdom | 114/222 |
| 1468764 | 3/1977 | United Kingdom | 114/61 |

*Primary Examiner*—Stephen G. Kunin
*Attorney, Agent, or Firm*—Neil E. Hamilton

[57] ABSTRACT

A punt floatable upon a water, so as to move alongside a ship, in order to paint a side thereof, the punt including a pair of cylindrical pontoons, supporting a frame, which, at each corner, includes upwardly telescoping posts carrying a platform on top, and the frame additionally including a machinery supported thereupon, for extending the telescoping posts.

4 Claims, 5 Drawing Figures

Fig. 1
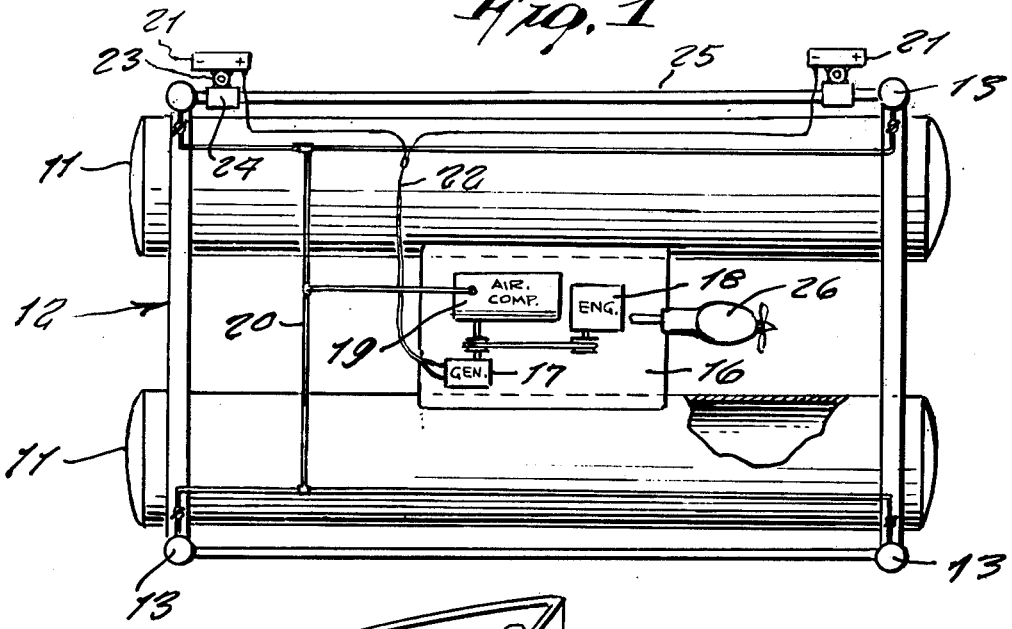
Fig. 2
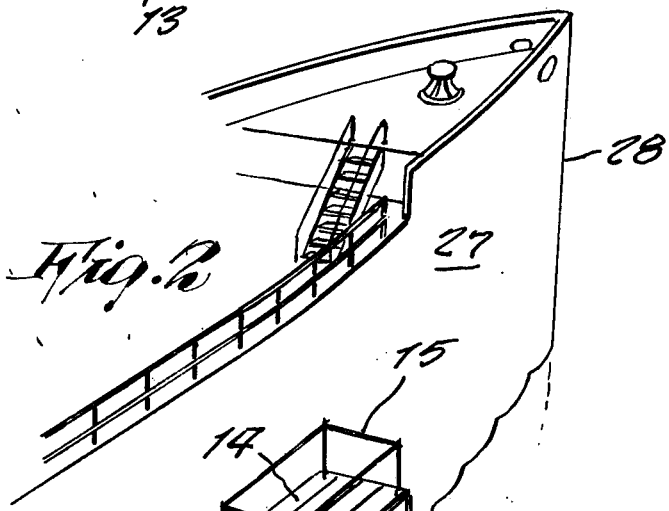
Fig. 3
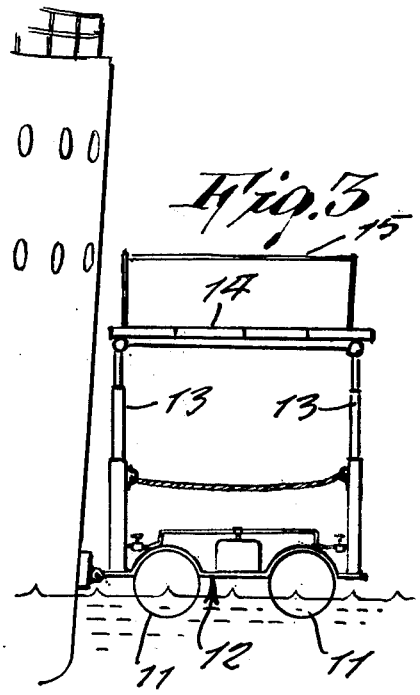
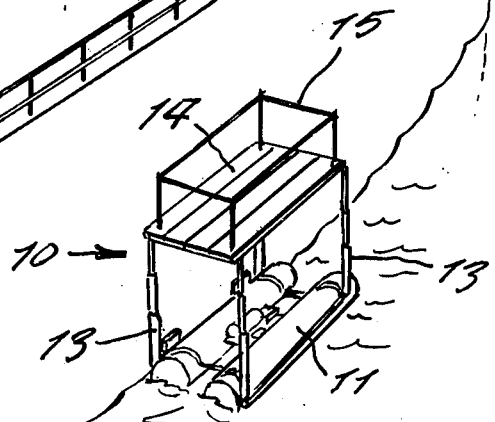
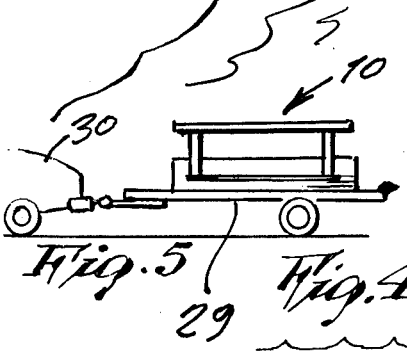
Fig. 5
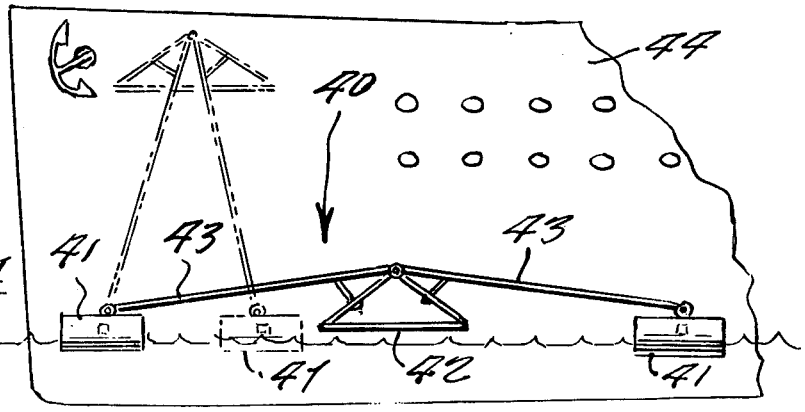
Fig. 4

FLOATING AIR ERECTING PAINTING PUNT

This invention relates generally to floating scaffolding.

A principal object of the present invention is to provide a punt, which can be floated alongside of a ship, so that the ship side may be painted by persons working upon the punt.

Another object of the present invention is to provide a punt, which can be used for painting large letters on a side of a ship.

Still another object is to provide a painting punt, which includes a vertically adjustable scaffold, so that workmen can be raised or lowered to any level alongside the ship.

Yet a further object of the present invention is to provide a painting punt, which carries its own air compressor machinery, used to elevate a platform of a scaffold thereof.

Yet a further object is to provide a painting punt, which is readily collapsible, so that, when not in use, it can be conveniently transported upon a trailer towed behind a vehicle.

Other objects are to provide a painting punt, which is simple in design, inexpensive to manufacture, rugged in construction, easy to use, and efficient in operation.

These, and other objects, will be readily evident, upon a study of the following specification, and the accompanying drawing wherein:

FIG. 1 is a top plan view of the present invention;

FIG. 2 is a perspective view thereof, shown secured by magnets alongside a ship;

FIG. 3 is an end view thereof, alongside the ship;

FIG. 4 is a side view, showing a modified design of the invention; and

FIG. 5 is a side view of the invention, shown collapsed, and transported upon a trailer of a vehicle.

Referring now to the drawing in greater detail, and more particularly, to FIGS. 1, 2 and 3 thereof at this time, the reference numeral 10 represents a painting punt, according to the present invention, wherein there are a pair of parallel, cylindrical pontoons 11, that are hollow, in order that they may float upon a water. The pontoons support a frame 12, which, at each corner, includes a vertically telescoping post 13. platform 14, surrounded by a removable hand railing unit 15.

A small deck 16, secured to the frame 12, is supported between the pontoons, and upon the deck, there is mounted a generator 17, that drives an engine 18, which, in turn, drives an air compressor 19, for delivering compressed air through piping 20, to each of the telescopic posts 13. The generator also provides electrical power to a pair of electromagnets 21, by means of wiring 22; the magnets providing a means for securing the punt to the metal side of a ship, in order to prevent the punts from floating away, while in operative use. The electromagnets are attached, by means of swivels 23, to a sleeve 24, slidable along a bar 25 of the frame, so that the magnets can be positioned wherever wished therealong, in order to be conveniently attachable to the ship.

An outboard motor 26 is also attached to the deck rear edge, and provides a means for propelling the punt across the surface of the water.

In operative use, it is now evident that workmen, wishing to paint a side 27 of a ship 28, can now stand upon the platform 14, and can be raised to any desired height, in order to paint the ship's side.

When the painting punt 10 is desired to be transported overland, the telescopic posts are retracted, in order to lower the platform to a minimum height, and the railing unit 15 is dismantled therefrom. Thus, the painting punt, as shown in FIG. 5, makes a compact device, that can be easily and conveniently transported upon a trailer 29, towed behind a towing vehicle 30 over a highway.

In FIG. 4, there is shown a modified design of painting punt 40, which, instead of the air powered jacks, consists of two short rafts 41, constructed of the above described pontoons 11, the rafts being adaptable to be brought either closer together, or further apart, alongside the ship, so that a platform 42, supported from a pair of booms 43, carried by each raft, can thus be raised or lowered, as is clearly shown by the solid lines and by the dotted lines of the drawing. Thus, the platform can be raised either higher or lower alongside a ship 44, to paint a side thereof.

It shall be noted, that painting punt 10 may be used on land, to paint apartments and homes.

It may also be used by electricians, tree surgeons, building contractors, etc. Providing painting punt 10, without electric magnets and an outboard motor, is optional, and a mobile trailer may be provided to haul it.

While various other changes may be made in the detail construction, it is understood that such changes will be within the spirit and scope of the present invention as is defined by the appended claims.

What I now claim is:

1. A painting punt for floating upon a body of water and for securing to the side of a ship comprising:

(a) a horizontal platform adapted to support workmen;

(b) a pair of pontoons that are hollow to permit flotation;

(c) a frame supported by said pontoons;

(d) means carried by said frame to secure said frame directly to the side of said ship;

(e) said frame further including a deck;

(f) an engine driven by a generator, said engine driving a compressor, said engine, generator and compressor all supported by said deck;

(g) said frame further including upward telescoping posts;

(h) said platform defined by a generally rectangular configuration having corners and spaced upwardly from said pontoons;

(i) said telescoping posts operatively connected to said platform at the corners thereof; and (j) piping means interconnected between said compressor and said posts whereby said posts are extended or contracted to raise and lower said horizontal platform.

2. The painting punt as defined in claim 1 further including an outboard motor secured to a rear edge of said deck.

3. The painting punt as defined in claim 1 wherein said means to secure said frame to said ship includes a pair of electromagnets secured to said frame and said generator provides electric power to said magnets.

4. The painting punt as defined in claim 1 wherein said frame includes booms pivotally secured to said platform and said frame whereby moving said pontoons closer or farther apart changes an elevation of said platform alongside said ship.

* * * * *

UNITED STATES PATENT OFFICE

CERTIFICATE OF CORRECTION

PATENT NO. : 4,153,000

DATED : May 8, 1979

INVENTOR(S) : Chuck A. Henderson

It is certified that error appears in the above-identified patent and that said Letters Patent are hereby corrected as shown below:

Column 1, line 46, after "post 13." please insert --

Upon the upper end of the posts, there is mounted a --

Signed and Sealed this

*Eighteenth* Day of *September 1979*

[SEAL]

*Attest:*

*Attesting Officer*

LUTRELLE F. PARKER

*Acting Commissioner of Patents and Trademarks*